United States Patent [19]

Suzuki et al.

[11] 4,423,282

[45] Dec. 27, 1983

[54] FLAT CABLE

[76] Inventors: Hirosuke Suzuki, 205-22, Kitanaka, Tokorozawa, Saitama-ken, Japan, 359; Norikazu Ishigohoka, 2175-82, Takahagi, Hidaka-machi Iruma-gun, Saitama-ken, Japan, 350-12

[21] Appl. No.: 278,871

[22] Filed: Jun. 29, 1981

[51] Int. Cl.[3] ..... H01B 11/04; H01B 7/08; H01B 11/06

[52] U.S. Cl. ..... 174/36; 174/110 FC; 174/110 F; 174/117 F; 174/120 SR

[58] Field of Search ..... 174/117 F, 117 FF, 110 FC, 174/110 F, 120 SR, 36

[56] References Cited

U.S. PATENT DOCUMENTS

| | | | |
|---|---|---|---|
| 2,392,388 | 1/1946 | Joyce | 174/110 FC |
| 2,484,484 | 10/1949 | Berry | 174/120 SR |
| 3,176,065 | 3/1965 | Alexander et al. | 174/120 R |
| 3,516,859 | 6/1970 | Gerland et al. | 174/110 F |
| 3,684,755 | 8/1972 | Gumerman | 174/110 FC X |
| 4,000,348 | 12/1976 | Harlow | 174/110 FC X |

FOREIGN PATENT DOCUMENTS

| | | | |
|---|---|---|---|
| 1147281 | 7/1961 | Fed. Rep. of Germany | 174/110 F |
| 2409363 | 9/1974 | Fed. Rep. of Germany | 174/117 F |
| 921453 | 3/1963 | United Kingdom | 174/110 FC |

OTHER PUBLICATIONS

Schinko, Herwig, "Flat Cables as Transmission Elements for Digital Systems", Siemens Review XLII (3/1975) No. 3, pp. 132–134, Inspec. SO52-7505x.

Mitchell, D. M., Dual Insulation Conserves Cable Materials", Bell Laboratories Record, 9/76, pp. 225–228, Inspec. S62250142c.

Kolias, John T., "How FEP and Flame Retardant PE Flat Cable Insulations Compare", Insulation/Circuits, Aug. 1973, pp. 23–24.

*Primary Examiner*—A. T. Grimley
*Assistant Examiner*—Morris H. Nimmo
*Attorney, Agent, or Firm*—Mortenson & Uebler

[57] ABSTRACT

An improved flat cable in which parallel, spaced conductors are embedded in an expanded, porous polytetrafluoroethylene insulation and then placed between layers of polytetrafluoroethylene having a higher dielectric constant than the porous insulation. The dielectric constant between conductors can be varied.

5 Claims, 2 Drawing Figures

FLAT CABLE

FIELD OF THE INVENTION

The present invention relates to a flat cable comprising a plurality of linear electrical conductors embedded in a belt form dielectric in a spaced parallel relationship throughout its length, and more particularly, to a flat cable having excellent electromagnetic signal transmission properties, dimensional stability and terminal resin strippability.

BACKGROUND OF THE INVENTION

It is generally known that good electric signal transmission properties in flat cables can be achieved by using for the dielectric a material having a low dielectric constant and low dielectric loss with little dependency on signal frequency.

The lower the dielectric constant of the dielectric, the more compact it is in size and the faster the signal propagation speed, if the characteristic impedance of the flat cable is the same. The smaller the dielectric loss, the smaller the signal dissipation becomes. The less frequency dependence of the dielectric constant and dielectric loss (e.g., pulse signals are caused to transmit through the flat cable) the smaller the pulse deformation is suppressed.

It is, therefore, required that the dielectric used in the flat cable have a low dielectric constant and low dielectric loss with little dependency on signal frequency. As one of such dielectric materials, expanded, porous polytetrafluoroethylene (PTFE) having a microstructure of numerous fine nodes interconnected by fine fibrils with continuous microscopic pores between the nodes and fibrils has been used. The expanded porous PTFE is, however, poor in dimensional stability since its texture is too soft. Thus, it is unsuitable as a dielectric of a flat cable, although it is used as a coaxial cable dielectric wrapped as a tape around a center conductor.

Furthermore, if a flat cable is made with the expanded porous PTFE alone as its dielectric, the spacing between conductors is dimensionally unstable and the stripping of the terminal dielectric material for connection is difficult, hence the flat cable so produced is almost impractical.

BRIEF DESCRIPTION OF THE INVENTION

The present invention solves the aforementioned problems by providing a two-part insulation of the same polymer in which one part, the part closest to the conductors, has a lower porosity than the exterior layer.

Figure 1:
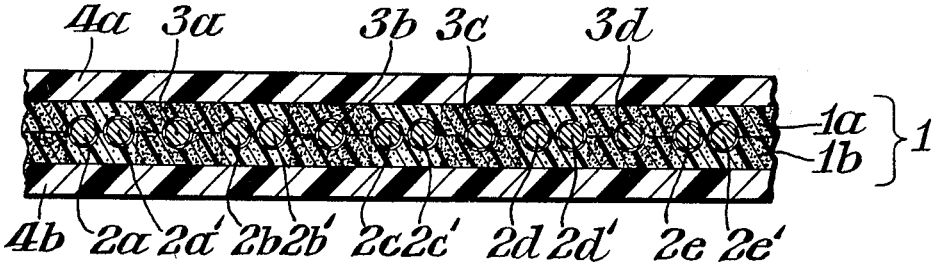
FIG. 1 shows a schematic cross section of a flat cable according to an embodiment of the present invention.

In the drawings, 1*a*, 1*b* is an expanded, porous PTFE material in sheet form, 2*a*–2*e'* and 3*a*–3*d* are conductors, 4*b* is an outside plastic layer, and 5 is a PTFE sheet.

DETAILED DESCRIPTION OF THE INVENTION

The expanded, porous PTFE as explained above satisfies all the electrical requirements for the flat cable dielectric (i.e., low dielectric constant and low dielectric loss with little dependence on frequency). The inventors have investigated how to make use of the excellent properties inherent in the EPTFE as a flat cable dielectric, while at the same time meeting the other flat cable requirements (i.e., dimensional stability and terminal insulation strippability). As a result, they have succeeded in producing the flat cable of the present invention in which the above contradictory requirements have been harmonized.

Referring to the drawings, explanation will be made on some embodiments of the present invention.

FIG. 1 shows an enlarged fragment of a cross section of an embodiment of the present invention. In this embodiment, two pieces of porous PTFE sheet, 1*a* and 1*b*, (each 0.25 mm in thickness), are employed. The sheet was prepared by stretching a shaped PTFE article, which had been held in a ca. 320° C. environment for 1 minute, at a stretch ratio of 3X, and then heating it in air to ca. 360° C. for ca. 30 seconds to produce a partially sintered porous PTFE sheet (the degree of sintering nearly 100%) having a dielectric constant of 1.3. Between the two partially sintered, expanded porous PTFE sheets, 1*a* and 1*b*, the desired number of conductors (e.g., silver plated copper wire of 0.18 mm diameter) are sandwiched in a predetermined, spaced, parallel relationship. In this case, wires 2*a*, 2*a'*; 2*b*, 2*b'*; 2*c*, 2*c'*; 2*d*, 2*d'*; and 2*e*, 2*e'* are ground conductors and wires 3*a*, 3*b*, 3*c* and 3*d* are signal conductors. In another embodiment of embedding the signal and ground conductors in the expanded PTFE dielectric, an expanded PTFE tape (same as that mentioned above) is caused to interweave the signal and ground conductors arranged in a spaced, parallel relationship (for example, in the same manner with the solid PTFE tape 5 installation mentioned below referring to FIG. 2). Next, two pieces of partially sintered expanded PTFE sheet, 1*a* and 1*b*, are affixed, one per side, to the both sides of the paralleled conductors interwoven with the expanded PTFE tape. The expanded PTFE dielectric surrounding the conductors thus formed increases the cable dimensional accuracy (particularly the uniformity and parallelism between adjacent conductors) and the cable dimensional stability due to the stronger adherence between the sheets 1*a* and 1*b* compared to the expanded PTFE dielectric produced by sandwiching the conductors between two expanded PTFE sheets 1*a* and 1*b* as shown in FIG. 1. Moreover, the expanded PTFE dielectric obtained by this interweaving method does not impair the signal propagation as compared to the cable of the embodiment shown in FIG. 2 in which a solid plastic tape is interlaced to the paralleled conductors. Unsintered, unexpanded PTFE tapes (e.g., 0.05 mm thick), 4*a* and 4*b*, are overlaid onto both sides of the partially sintered, porous PTFE sheets, 1*a* and 1*b*, having the ground and signal conductors sandwiched between them, to make a flat or band shaped assembly. This assembly is then passed through at least one pair of compression rolls (not shown) to bond the elements together. The assembly is then held for ca. 30 seconds in a molten salt bath maintained at ca. 370° C. In the embodiment shown in FIG. 1, only 14 conductors, signal and ground wires inclusive, appear due to drawing convenience, but in the actual embodiment a flat cable having a total of 72 signal and ground wires was produced with 0.475 mm spacing between signal and ground wires, and 0.400 mm spacing between adjacent ground wires, and having 100Ω characteristic impedance.

The electric signal propagation delay of the flat cable thus obtained was as fast as 3.9 nsec/m, as compared to 4.6 nsec/m of a solid PTFE flat cable. The pulse transmission property and cross-talk between stacked cables of the present invention were proved to be excellent.

As stated above, the unsintered, unstretched PTFE tapes 4*a* and 4*b* were affixed onto both sides of layer 1, consisting of the porous PTFE sheets 1*a* and 1*b*, and sintered together. Due to these outside tapes, 4*a* and 4*b*, dimensional stability of the flat cable is increased, and the insulation at the end of the cable can be easily removed in the lengthwise direction, thus allowing for an effective and sure cable terminal.

Figure 2:
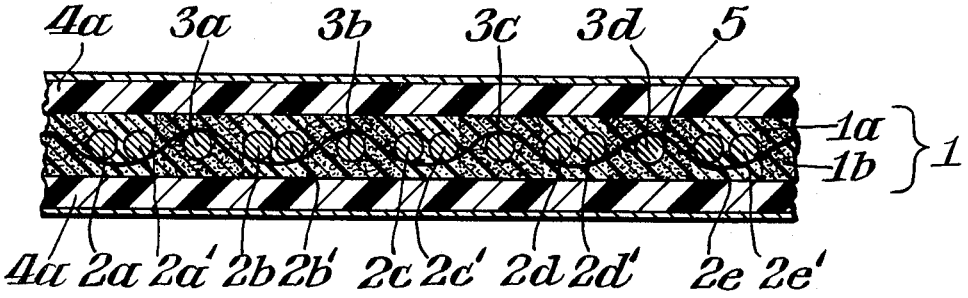
FIG. 2 also shows a schematic cross section of a flat cable according to another embodiment of the present invention.

Refer next to FIG. 2 showing the second embodiment of the present invention. In this embodiment, the ground and signal conductors to be sandwiched between the two sheets, 1*a* and 1*b*, are interlaced with an unsintered PTFE tape 5 (e.g., ca. 0.1 mm thick) in a wave form fashion. The other elements can be the same as those used in the first embodiment; hence, the counterparts are numbered the same as in FIG. 1.

According to the embodiment as shown in FIG. 2, a 95Ω flat cable measuring 0.65 mm in thickness, with 0.475 mm spacing between signal and ground wires, and 0.400 mm spacing between adjacent ground wires, was produced. The electric signal propagation delay time of this flat cable was as fast as 4.0 nsec/m. No break occurred as a result of an AC voltage application of 2,000 volts for 1 minute between signal and ground conductors. The pulse transmission and cross-talk of the flat cable of the present invention were superior to those of conventional flat cables.

In either of the above embodiments as shown in FIG. 1 or FIG. 2, the webbed portion between a transmission channel consisting of one pair of signal and ground conductors and an adjacent transmission channel can be more strongly squashed, by using a compression roll or rolls having projections corresponding to the webbed portion, to produce a flat cable having grooves on one or both sides. By doing this, the porosity of the grooved or webbed portion of the flat cable is reduced; thus, deformation due to stress in the direction of cable thickness is advantageously prevented.

The signal wires can be insulated with a resin, for example PFA (0.05 mm in thickness). In an example of this, the characteristic impedance became 97Ω, and the propagation delay time was 4.0 nsec/m; but, no break of insulation occurred when an electric voltage of 2,000 V was applied between ground conductors for one minute. Besides PFA, such insulating materials include, for example, non-porous fluorinated resins, such as PTFE, FEP, etc. Enamels such as polyimide, polyamide-imide and the like may also be used. By using non-porous resin insulation over the conductors, the bond between the conductor and the expanded, porous PTFE dielectric is strengthened, thus providing another advantage against conductor-dielectric slippage. Moreover, by the application of the non-porous resin layer over the conductor, the whiskers or migration (liable to occur on the surface of tin or silver-plated conductors) are also prevented. In the above instance, the non-porous resin insulation was produced only over the signal conductors; however, it can of course be applied to any conductors, either signal or ground, in a desired manner depending on the requirement.

As can be understood from the foregoing explanation, the disadvantages detailed in the beginning of the specification can be overcome quite effectively and at the same time increases the dielectric insulation breakdown voltage between the surface of the cable and the conductor. Moreover, by the installation of the uniform resin layers (having a dielectric constant higher than that of porous PTFE) over the porous PTFE dielectric, in which the conductors are embedded, the electric field formed between conductors is less radiated outside the cable. Thus, signal leakage between layers, encountered when the flat cables are used in a stacked manner, and cross-talk with neighboring transmission lines are greatly reduced.

As the need arises, an electro-magnetic shielding layer, such as metal sheet or electro-conductive fluorocarbon may be installed onto the outside plastic layer. In addition, a jacket, such as extruded PVC, may also be fabricated on.

In the embodiments shown in the drawings, the conductors were depicted as solid lines having circular cross-sections, but may include an arbitrary conductor, such as stranded copper wire, flat copper wire, silver-plated copper wire, copper-clad steel wire, gold plated stainless steel wire, etc.

The above explanation has been made with reference to specific embodiments, but the present invention is not limited to these embodiments. The present invention can of course include any possible embodiments within the scope of the claim.

We claim:

1. A flat cable comprising a plurality of conductors, arranged in a parallel spaced relationship and embedded in a expanded porous polytetrafluoroethylene insulation the dielectric constant of said porous insulation being variable between adjacent conductors; said embedded conductors contained within said insulation being contained between at least two layers of a substantially nonporous polytetrafluoroethylene insulation having a higher dielectric constant than said porous insulation.

2. The cable of claim 1 wherein a plastic tape interlaces said conductors.

3. The cable of claim 1 wherein said conductors are coated with a nonporous resin material.

4. The cable of claim 1 having an electromagnetic shielding layer affixed to the external surfaces of said nonporous insulation layers.

5. The cable of claim 1 wherein the porous dielectric insulation is compressed at locations between and adjacent conductors such that the dielectric constant of the porous insulation is increased at locations between conductors and adjacent conductors as a result of said longitudinal compression of the cable.

* * * * *